United States Patent [19]

Oguro et al.

[11] Patent Number: 4,565,039

[45] Date of Patent: Jan. 21, 1986

[54] FLOOR STRUCTURE FOR REDUCING VIBRATION

[75] Inventors: Sadao Oguro, Chofu; Yukio Sakagami, Mitaka; Takayuki Ando, Yokosuka, all of Japan

[73] Assignees: Ohbayashi-Gumi, Ltd., Osaka; Tokico Ltd., Kanagawa, both of Japan

[21] Appl. No.: 587,000

[22] Filed: Mar. 7, 1984

[51] Int. Cl.[4] ..... E02D 27/34; E04H 9/02

[52] U.S. Cl. ..... 52/167; 248/567; 248/636; 248/638; 267/140.5

[58] Field of Search ..... 52/167; 248/567, 562, 248/636, 638; 267/140.5

[56] References Cited

U.S. PATENT DOCUMENTS

| | | | |
|---|---|---|---|
| 2,055,000 | 9/1936 | Bacigalupo | 51/167 |
| 2,359,915 | 10/1944 | Hussman | 248/562 |
| 2,631,841 | 3/1953 | Tillou et al. | 52/167 |
| 3,390,854 | 7/1968 | Sherburne | 248/55 |

FOREIGN PATENT DOCUMENTS

| | | | |
|---|---|---|---|
| 675982 | 12/1963 | Canada | 52/167 |
| 68364 | 6/1978 | Japan | 248/638 |
| 55-41384 | 3/1980 | Japan . | |
| 124843 | 7/1983 | Japan | 248/638 |
| 699111 | 11/1979 | U.S.S.R. | 52/167 |
| 896190 | 1/1982 | U.S.S.R. | 52/167 |

*Primary Examiner*—John E. Murtagh
*Assistant Examiner*—Caroline Dennison
*Attorney, Agent, or Firm*—Wenderoth, Lind & Ponack

[57] ABSTRACT

A floor structure for reducing vibration comprises a panel for mounting a load thereon and a plurality of shock absorbers elastically supporting the panel over a base floor, each shock absorber comprising a base plate slidably mounted on the base floor, a longitudinal spring fitted between the panel and the base plate and a damper swingably connected at respective ends thereof to the panel and the base plate respectively. At least one of the shock absorbers includes a plurality of horizontal springs normally maintaining such shock absorber at a predetermined position with respect to the base floor.

7 Claims, 3 Drawing Figures

FLOOR STRUCTURE FOR REDUCING VIBRATION

BACKGROUND OF THE INVENTION

The present invention relates to a floor structure for reducing vibrations caused by, for example, an earthquake or a device mounted on the floor.

The recent advancement in scientific technology particularly in the field of electronics has offered various kinds of precision instruments such as a computer, telecommunication equipment and the like which, due to precision thereof, require that no intense vibration be transmitted thereto. Those precision machines are often installed in a tower building which, however, is not designed to prevent transmission of vibrations to upper floors thereof when an earthquake occurs. Therefore, it is absolutely necessary to provide a means for reducing the vibration transmitted to those machines thereby to protect the latter.

Also, there have been used recently, various devices that themselves create vibrations, and some of such devices are used even in the offices. It is advantageous to prevent the vibration caused by such devices from spreading.

For reducing or damping the vibration transmitted between the floor and the precision machines or the vibration creating devices, a structure has been hitherto employed in which each of the machines or devices is elastically supported by elastic means such as coil springs which are in turn fixed at lower ends thereof to the floor. However, the floor has in many cases dual slabs to provide, between a lower slab and upper slab or base floor, a space for arranging pipes and complicated wiring of the machines, and it is the lower slab to which the support springs are fixed in order to avoid considerable reinforcement to stanchions which support the base floor. Therefore, after the machines or devices are arranged in a room, rearrangement thereof necessitates an alteration and repair of the base floor and is thus inconvenient.

Furthermore, an earthquake usually involves vibration in both vertical and lateral directions, and some of the devices also creates such vibration. The known structure of the above type can not effectively protect the machines from such nonuniform vibration, particularly from the lateral vibration.

Accordingly, an object of the present invention is to provide a floor structure for reducing the vibration and which permits arrangement and rearrangement of machines or devices supported by the floor structure without substantial alteration and repair of a preconstructed floor of a building or other construction.

Another object of the present invention is to provide a floor structure which may reduce or damp vibration in both vertical and lateral directions thereby to protect machines from such nonuniform vibration.

A further object of the present invention is the provision of a floor structure which is simple and may be manufactured at low cost.

SUMMARY OF THE INVENTION

According to the present invention, a floor structure for reducing vibration comprises a panel for mounting a load thereon and positioned over a base floor, and a plurality of shock absorbers disposed between the panel and the base floor and elastically supporting the panel. Each shock absorber comprises a base plate mounted on the base floor in such a manner that the base plate is slidable in the horizontal direction with respect to the base floor, a longitudinal or vertical spring fitted between the panel and the base plate, and a damper having two ends, one end thereof being swingably connected to the base plate and the other end thereof being swingably connected to the panel. At least one of the shock absorbers is provided with a plurality of horizontal springs which maintain the one of the shock absorbers at a predetermined position with respect to the base floor when no vibration occurs.

Preferably, a means for decreasing frictional resistance is fitted between the base floor and the base plate thereby making the base plate slidable relative to the base floor.

The base plate of the at least one of the shock absorbers may include a plurality of hook pins and the base floor may have corresponding fixed pins, each horizontal spring being engaged at one end thereof with one hook pin and at the other end with one fixed pin.

Each shock absorber preferably includes a lower case fixed at the lower end thereof to the base plate and an upper case fixed at the upper end thereof to the panel. The longitudinal spring and the damper may be disposed within the lower and upper cases.

More preferably, the lower end of the upper case surrounds the upper end of the lower case with a predetermined space therebetween.

Other objects, features and advantages of the present invention will be apparent from the following detailed description of preferred embodiments thereof when taken in conjunction with the accompanying drawings, in which:

DETAILED DESCRIPTION OF THE INVENTION

Figure 1:
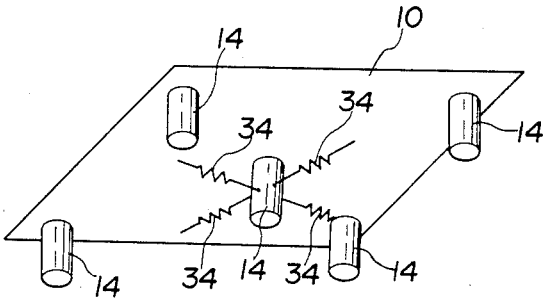
FIG. 1 is a perspective view illustrating a panel with shock absorbers employed in a floor structure for reducing vibration according to a preferred embodiment of the present invention.
Figure 2:
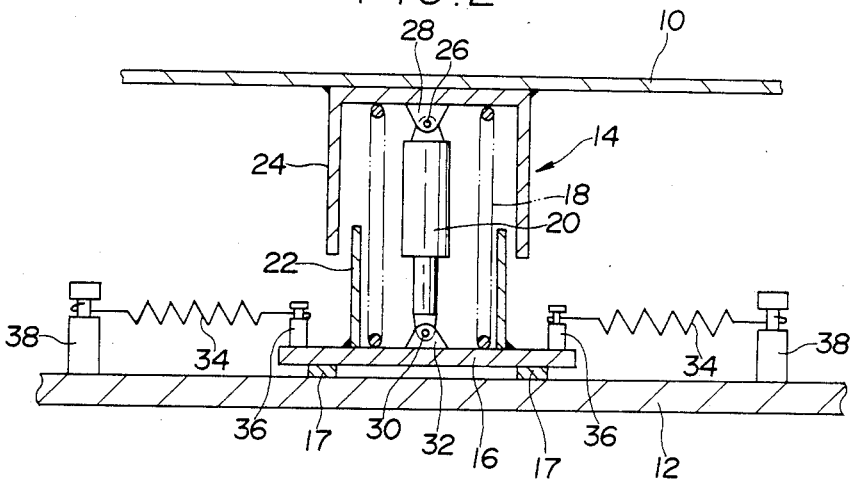
FIG. 2 is a longitudinally sectioned view of the panel and one of the shock absorbers in FIG. 1 after being mounted on a base floor.

Referring now to FIGS. 1 and 2 of the drawings, there is shown a floor structure for reducing vibration or shock according to a preferred embodiment of the present invention. Such a floor structure includes a panel 10 having a rectangular or any other desired shape and adapted to support various loads to be mounted on the upper surface of the panel 10. The load mounted on the panel 10 may be a precision machine, such as a computer, the application to which of excessive vibration is to be avoided or such equipment that itself creates the vibration, e.g. a reciprocating compressor. The panel 10 is supported in its position over a base floor 12 of a building or other construction, by means of a plurality of shock absorbers 14 each of which is disposed at a predetermined position on the lower surface of each panel 10.

As best shown in FIG. 2, the shock absorber 14 comprises a base plate 16, longitudinal spring or springs 18 and a damper 20. The base plate 16 is mounted on the base floor 12 in such a manner that the base plate 16 may be slidably movable in the horizontal direction with respect to the base floor 12. Provided for this purpose between the upper surface of the base floor 12 and the lower surface of the base plate 16 is a means for decreasing frictional resistance therebetween, which in this embodiment is a plurality of runner plates 17 formed of plastics such as polytetrafluoroethylene (known as trademark Teflon), but other suitable means such as roller bearings may be also employed to slidably support the base plate 16. A lower cylindrical case 22 is fixed at the lower open end thereof to the upper surface of the base plate 16, and an upper cylindrical case 24 is integrally connected at the upper closed end thereof to the lower surface of the panel 10. The total length of the lower and the upper cylindrical cases 22 and 24 is more than the distance between the panel 10 and the base plate 16, and the upper cylindrical case 24 has a larger diameter than that of the lower cylindrical case 22 so that the lower open end of the cylindrical case 24 surrounds the upper end of the cylinder 22 with a predetermined radial space therebetween.

The coil springs 18 extend axially between the base plate 16 and the upper closed end of the cylindrical case 24 and bear, in cooperation with the damper 20, the weight of the cylindrical case 24 supporting the panel 10 and the loads mounted on the latter. The damper 20 is located radially inside the springs 18 and may promote the decrease of the vibration by expansion and contraction thereof. The upper end of the damper 20 is swingably connected by a pin 26 to a bracket 28 which is fixed to the upper closed end of the cylindrical case 24, and similarly a pin 30 swingably connects the lower end of the damper 20 to a bracket 32 fixed to the base plate 16.

At least one of the shock absorbers 14 is provided with plural horizontal springs 34 extending parallel to the base floor 12 for preventing free movement of the panel 10 with respect to the base floor 12 and for the purpose hereinafter described. In the embodiment illustrated only the shock absorber 14 disposed centrally of the panel 10 is provided with such springs 34, but it should be understood that any or all of the other shock absorbers 14 may also have such springs. The number of the horizontal springs should be more than three, and in this embodiment four springs 34 radially extend from the central shock absorber 14. For positioning these springs in a stretched condition, hook pins 36 project upwardly from the periphery of the base plate 16 to engage first ends of the springs 34, and corresponding pins 38 are fixedly mounted on the base floor 12 for engagement with second ends of the springs.

Assuming now that the loads are mounted on the panel 10, when an earthquake involving vibrations in both longitudinal or vertical and lateral directions occurs, the base floor 12, together with the building or other construction, vibrates simultaneously. At this time, the longitudinal vibration is reduced or eased by the elasticity of the coil springs 18 and the damper 20 and only the reduced vibration is transmitted to the panel 10. Also, since the runner plates 17 permit lateral displacement of the base plate 16 relative to the base floor 12, the lateral vibration mainly transmitted to the base plate 16 through the horizontal springs 34 and a friction damper constituted by the runner plates is reduced by the horizontal springs 34.

As soon as the earthquake subsides, the horizontal springs 34 will restore the central shock absorber 14 and, therefore, the panel 10 to the predetermined position with respect to the base floor 12.

On the other hand, if the load mounted on the panel 10 is a machine that itself creates the vibrations, those vibrations may be reduced by the shock absorbers 14 and then transmitted to the base floor 12, i.e. to the building. Thus, the base floor 12 can be efficiently used for providing a comfortable space around the panel 10.

Figure 3:
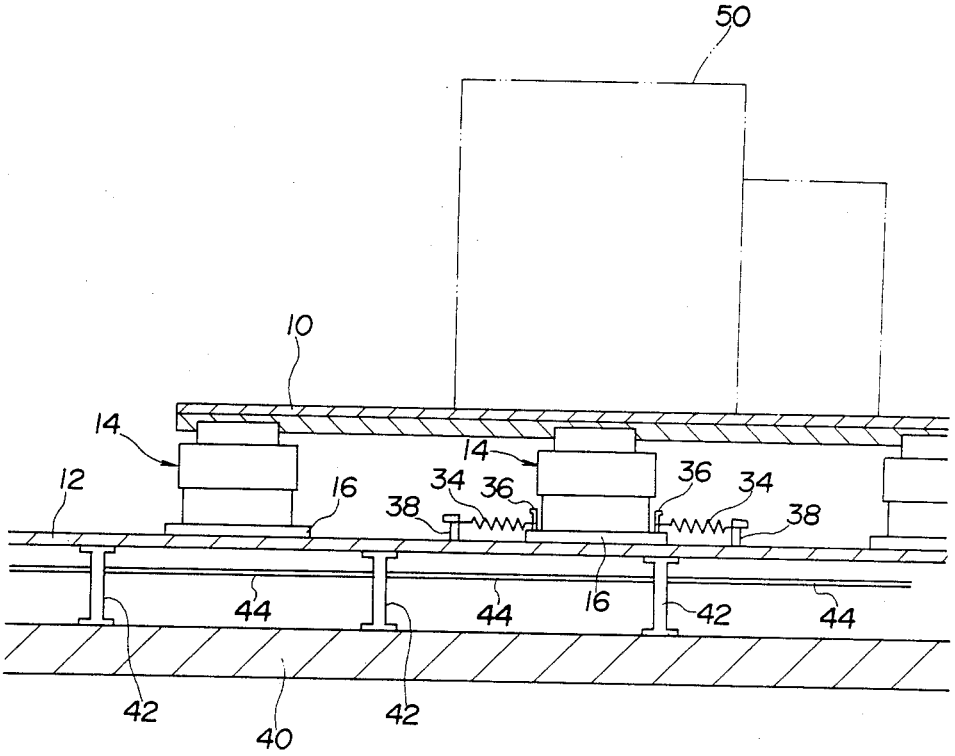
FIG. 3 is a sectional view illustrating the floor structure in FIGS. 1 and 2 with a lower slab of a building.

For further facilitating the understanding of the advantages of the present invention, description will be given with reference to FIG. 3 in which the base floor 12 is illustrated in more detail. Usually, the base floor 12 of a room for installing precision machines or vibrating devices is supported over a lower slab 40, which is integral with the building or other construction, by a plurality of steel stanchions 42. The space provided between the slab 40 and the base floor 12 may be used to arrange a plurality of pipes for air conditioning or the like and complicated wiring, and the height of this space is generally 150 to 200 mm which would not permit a means for reducing the vibrations to be mounted therein. Therefore, if such means would have to be supported by the slab 40, the base floor 12 would have to be considerably altered. However, since the present invention provides the panel 10 supported by the shock absorbers 14 which are mounted on the base floor 12, no modification to the original or preconstructed floor structure is necessary except that the stanchions 42 are connected to each other by reinforcing members 44. The loads indicated by numeral 50 may be mounted on the panel 10, as described hereinbefore.

In the foregoing embodiment, the longitudinal and horizontal springs 18 and 34 are simply fitted to their positions. If desired, however, the elastic force of such springs may be adjustable by adding suitable means such as adjustment screws. This additional structure will make it possible to adjust a position of the panel 10 in order to avoid tilting thereof when each of the longitudinal springs bears a different weight, and to adjust the location of the panel 10 relative to the base floor 12 by the lateral springs.

As will be understood from the above description, according to the present invention the vibrations in both vertical and lateral directions may be reduced before being transmitted from the base floor 12 to the panel 10, or in the opposite direction. Therefore, the loads on the panel 10 can be protected from an earthquake, while the base floor 12 may be protected from vibrations of the devices on the panel 10. In addition, the panel 10 and the shock absorber 14 may be standardized for mass-production and installed on the base floor 12 without serious alterations to the original floor structure.

Although the present invention has been described with reference to the preferred embodiments thereof, many modifications and alterations may be made within the spirit of the present invention.

What is claimed is:

1. A floor structure for reducing vibration, said structure comprising:

a panel for mounting a load thereon and positioned over a base floor;

a plurality of shock absorbers disposed between said panel and said base floor and elastically supporting said panel;

each said shock absorber comprising a base plate mounted on said base floor in such a manner that said base plate is slidable in the horizontal direction with respect to said base floor, a longitudinal spring fitted between said panel and said base plate, and a damper having a first end swingably connected to said base plate and a second end swingably connected to said panel; and at least one of said shock absorbers being provided with a plurality of horizontal springs maintaining said one of said shock absorbers at a predetermined position with respect to said base floor when no vibration occurs, each said horizontal spring having a first end secured to said base plate and a second end secured to said base floor.

2. A floor structure as claimed in claim 1, wherein a means for decreasing frictional resistance is fitted between said base floor and said base plate such that said base plate is slidable relative to said base floor.

3. A floor structure as claimed in claim 1, wherein said base plate of said at least one of said shock absorbers includes a plurality of hook pins, and said base floor has corresponding fixed pins, each said horizontal spring being engaged at said first end thereof with a respective said hook pin and at said second end thereof with a respective said fixed pin.

4. A floor structure as claimed in claim 1, wherein each of said shock absorbers further comprises a lower cylindrical case fixed at a lower end thereof to said base plate and an upper cylindrical case fixed at an upper end thereof to said panel, said longitudinal spring and said damper being disposed inside said lower and upper cylindrical cases.

5. A floor structure as claimed in claim 4, wherein a lower end of said upper cylindrical case surrounds an upper end of said lower cylindrical case with a predetermined space therebetween.

6. A floor structure as claimed in claim 1, wherein said ends of said damper are swingably connected by pins.

7. A floor structure as claimed in claim 1, wherein each said shock absorber has a plurality of said longitudinal springs, and said damper is disposed radially inside said plural longitudinal springs.

* * * * *